US008272769B2

(12) United States Patent
Bassani

(10) Patent No.: US 8,272,769 B2
(45) Date of Patent: Sep. 25, 2012

(54) MODULAR LIGHTING FIXTURE WITH IMPROVED DEVICE FOR CONNECTING THE ARMS TO THE RESPECTIVE SUPPORT

(75) Inventor: Paolo Bassani, Pisogne (IT)

(73) Assignee: Francesso Voltolina, Settat (MA)

( * ) Notice: Subject to any disclaimer, the term of this patent is extended or adjusted under 35 U.S.C. 154(b) by 38 days.

(21) Appl. No.: 12/931,952

(22) Filed: Feb. 15, 2011

(65) Prior Publication Data

US 2011/0199775 A1 Aug. 18, 2011

(30) Foreign Application Priority Data

Feb. 15, 2010 (IT) ..... MI2010A0222

(51) Int. Cl.
*F21S 8/06* (2006.01)

(52) U.S. Cl. ..... 362/405; 362/406; 362/408

(58) Field of Classification Search ..... 362/404, 362/405, 406, 408
See application file for complete search history.

(56) References Cited

U.S. PATENT DOCUMENTS 5,873,652 A * 2/1999 Bayer et al. ..... 362/405
5,906,520 A * 5/1999 Frinker et al. ..... 439/841
6,422,722 B1 * 7/2002 Voltolina ..... 362/405
6,565,240 B1 * 5/2003 Wu ..... 362/405
6,793,383 B2 * 9/2004 Wu ..... 362/405
6,923,677 B2 * 8/2005 Hsu ..... 439/531
7,387,522 B2 * 6/2008 Janos et al. ..... 439/314
7,455,433 B2 * 11/2008 Pazula et al. ..... 362/405

FOREIGN PATENT DOCUMENTS

EP 1030995 8/2000

* cited by examiner

*Primary Examiner* — Ali Alavi
(74) *Attorney, Agent, or Firm* — Bucknam and Archer

(57) ABSTRACT

A modular lighting fixture (10) is provided with a plurality of arms (16) branching off a central support (14) wherein they are inserted pressure-wise starting from the respective bottom ends. The central support comprises a containment body (18) wherein a plate (20) is arranged, with concentric seats (22,24) for as many spiral electrical conductors (22', 24') surmounted by a cylindrical plate (26) of insulating material wherein a plurality of through seats (28) with circular plan or wells is peripherally obtained, starting from a plane (30), wherein the bottom ends of arms (16) are inserted, provided with the electrical cables (42) for powering a lighting body connected to the opposite top end of the same arms. The bottom end of the arms is made integral to a sleeve (40) provided, along the base perimeter, with a vertical notch (40') intended for coupling with a projection (52) protruding from the outer side surface of a cylindrical body (48), whereon the sleeve is fitted pressure-wise.

9 Claims, 5 Drawing Sheets

16
42
42
40
50
50
48
44'
44'

64
54
56
28
32
40
44
44
26
50
28'
22'
28'
48
24'
T2
T2
44'
44'
24'
66
68
68
22'
18
58

Fig. 7
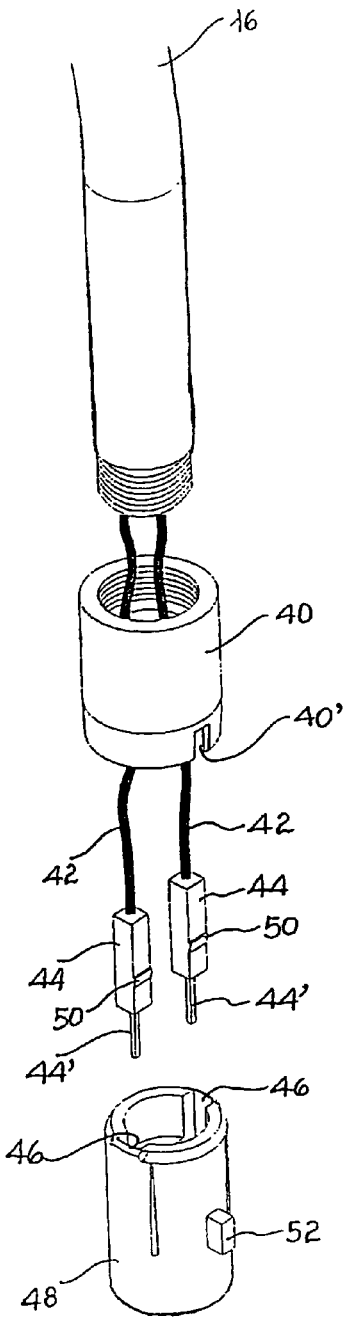
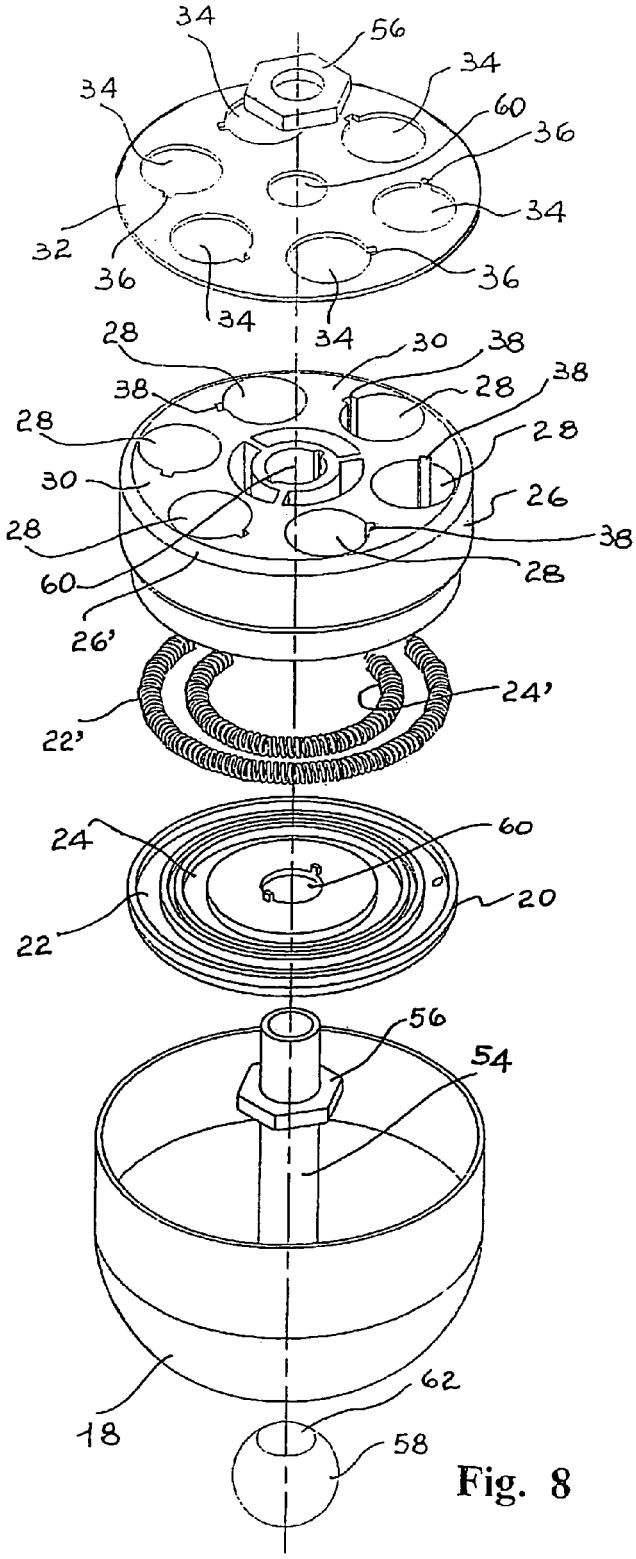
Fig. 8

MODULAR LIGHTING FIXTURE WITH IMPROVED DEVICE FOR CONNECTING THE ARMS TO THE RESPECTIVE SUPPORT

BACKGROUND OF THE INVENTION

The present invention relates to a modular lighting fixture with improved device for connecting the arms to the respective support.

More in particular, the present invention relates to a modular lighting fixture wherein one or more arms carrying the lighting body or bodies are inserted in the respective support for obtaining both the mechanical connection and the electrical connection by an improved device. The latter is obtained at al end of each arm and fits into a support and containment seat formed on a central body. The term "lighting fixture" used in the present description preferably refers to a ceiling chandelier with arms branching off a central support, made of glass, crystal or other suitable material but the same term may refer to a wall lamp of appliqué with one or more arms, or other types of lamps, for example floor or table lamps.

As known, several types of fixtures used for interior lighting exist. A traditional and widespread embodiment of these fixtures consists of the so-called chandelier with arms, which is installed on the ceiling and is provided with at least one central support wherefrom the same arms branch off with radial pattern. The latter, similar to the relative support, may be made of the most varied materials, from crystal to wood, to ceramic, metal and so on; in any case, they are chandeliers suitable for artistic and especially precious embodiments, if made with crystals and handicraft processes wherein the manual activity leads to obtaining real artistic creations. Both in this case and in the case of chandeliers with glass arms or other less precious materials, besides processing the single components, subsequent works are required for assembling and setting up electrical connections between arms and central body. The finished chandelier, that is, assembled in it components, exhibits the further problem of handling, for the transport and installation thereof at the end user. Especially in the case of large sized chandeliers, with multiple and greatly projecting arms, the transportation is difficult and the arms are thus removed from the relative support, in order to substantially limit the overall dimensions for transportation. In this case it is then required to assemble the various elements again and restore the mechanical and electrical connections; both the preventive removal and the assembly after transportation require long times, therefore considerable costs, and moreover it requires the intervention of experts.

Solutions are known wherein the chandeliers with arms of the above type at an end comprise quick connection means to a central support for obtaining at the same time, both the mechanical fixing of the arms and the contacts for the electrical power.

A solution of this type is for example described in EP1030995. However, this solution exhibits some considerable drawbacks. In a chandelier made according to the teaching of the above patent, in fact, connecting the arms to the respective seat of the central support requires works for welding the electrical cables and setting up an enclosure, or manifold, which encloses the two half-shells constituting the male fitting to be inserted in one of the seats of the central support. Besides constituting a complex and therefore expensive assembly, this solution exhibits significant overall dimensions, since the total diameter of the male fitting is considerably increased by the presence of the manifold that encloses the half-shells. As a consequence, also the central support exhibits a large diameter as it has to receive multiple seats for said fittings for which, among the other things, the electrical safety standards impose precise safety distances. With these limits, the supports of the chandeliers made according to the solution of said patent easily reach and exceed the diameter of 200 millimetres, so that the chandelier provided with dimensionally proportioned arms globally is cumbersome and therefore, not suitable for all the environments. In substance, the known solution mentioned above that provided for the quick connection of the arms to the central support does not meet the requirement of making chandeliers of limited size for not very large environments.

Due to the overall dimensions of the fixture, there occur problems both in the packaging step and in the transportation and storage of the relative enclosures wherein the same fixture is arranged; in situations of this type, breakage of the arms may easily occur, even if only partial.

Said known solution, moreover, exhibits the drawback relating to the bending of the arms which, especially if made of plastic material, with the passing of time tend to weaken, changing their initial position with the risk of cracks and breakage.

A further drawback found in the above solution relates to the centering and phasing of the arms, which is determined by a shape coupling between one end of the same and the shape of the relative seat. In this known embodiment, in fact, there is not the certainty that the arms can fully insert into the respective seat, for example due to foreign bodies, moulding burrs of the components and the like, so failures may occur due to imprecise electrical contacts.

SUMMARY OF THE INVENTION

The object of the present invention is to obviate the drawbacks mentioned hereinabove.

More in particular, the object of the present invention is to provide a modular lighting fixture wherein the arms are connected to the respective support so as to considerably reduce the overall dimensions compared to the known solutions. A further and consequent object of the invention is to provide a modular lighting fixture suitable for being easily packaged, transported and stored thanks to its limited dimensions.

A further object of the invention is to provide a modular lighting fixture wherein the arms, once connected to the respective support, are effectively stabilised and safe from possible bending which, over time, may give rise to cracks and breakage of the same arms.

Last but not least, an object of the invention is to provide a modular lighting fixture suitable for allowing, in the step of centring and coupling the arms to the respective supports, a precise abutment and the effective connection of the electrical contacts.

A further object of the invention is to provide the users with a modular lighting fixture intended for ensuring high levels of resistance and reliability over time, also such as to be easily and inexpensively constructed.

These and other objects are achieved by the modular lighting fixture of the present invention, provided with a plurality of arms branching off a central support wherein they are inserted pressure-wise starting from the respective bottom ends thereof, said central support comprising a containment body wherein a plate is arranged, with concentric seats for as many spiral electrical conductors surmounted by a cylindrical plate of insulating material wherein a plurality of through seats with circular plan or wells is peripherally obtained, starting from a plane, wherein the bottom ends of said arms are inserted, provided with electrical cables for powering a lighting body connected to the opposite top end of the same arms, which is essentially characterised in that the bottom end of the latter is made integral to a sleeve provided, along the base perimeter, with a vertical notch intended for coupling with a projection protruding from the outer side surface of a cylindrical body whereon the sleeve itself is fitted pressure-wise.

BRIEF DESCRIPTION OF THE DRAWINGS

The construction and functional features of the modular lighting fixture of the present invention shall be better understood from the following detailed description, wherein reference is made to the annexed drawing tables showing a preferred and non-limiting embodiment thereof, wherein:

FIG. 7 schematically shows an exploded view of the bottom side of one of said arms;

FIG. 8 schematically shows an exploded view of the central support whereto the arms are connected;

DETAILED DESCRIPTION OF THE INVENTION

Figure 2:
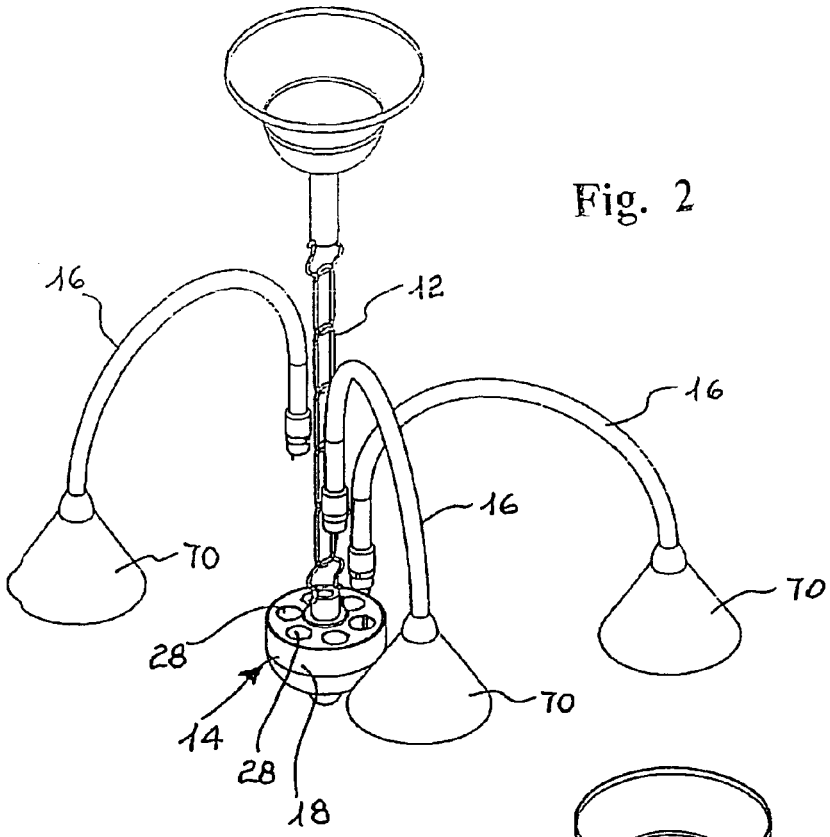
FIG. 2 schematically shows an exploded perspective view of the central support and the arms not yet connected to the same support of the lighting fixture of FIG. 1.
Figure 1:
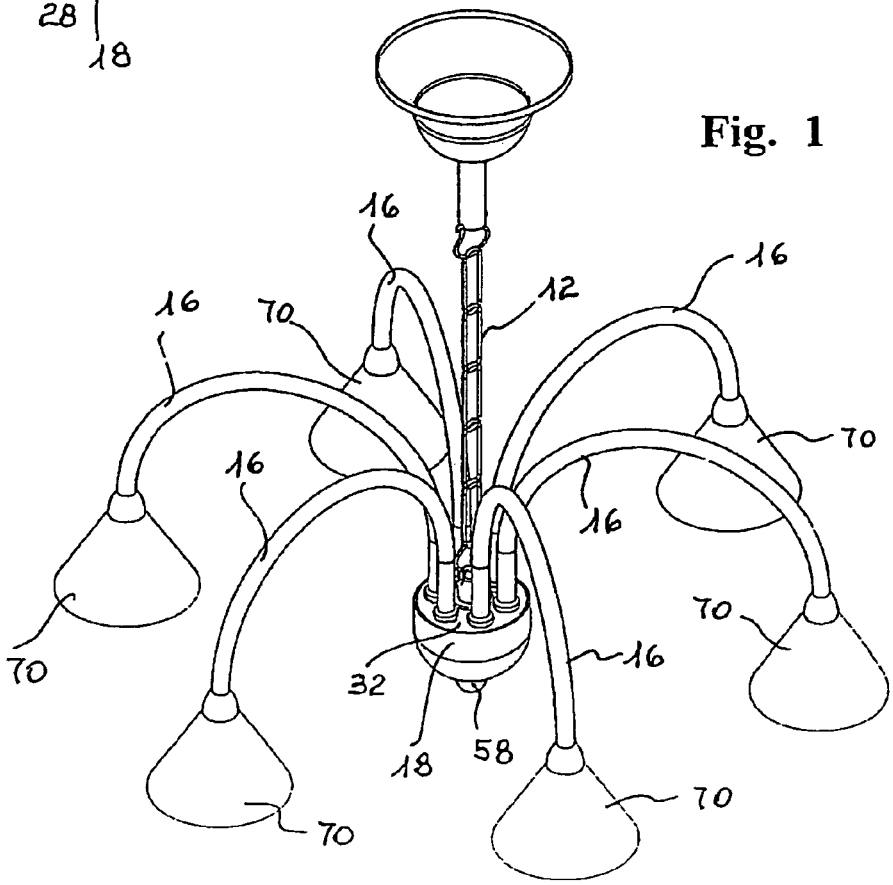
FIG. 1 schematically shows a perspective view of a model of a modular lighting fixture according to a possible embodiment of the invention.
Figure 3:
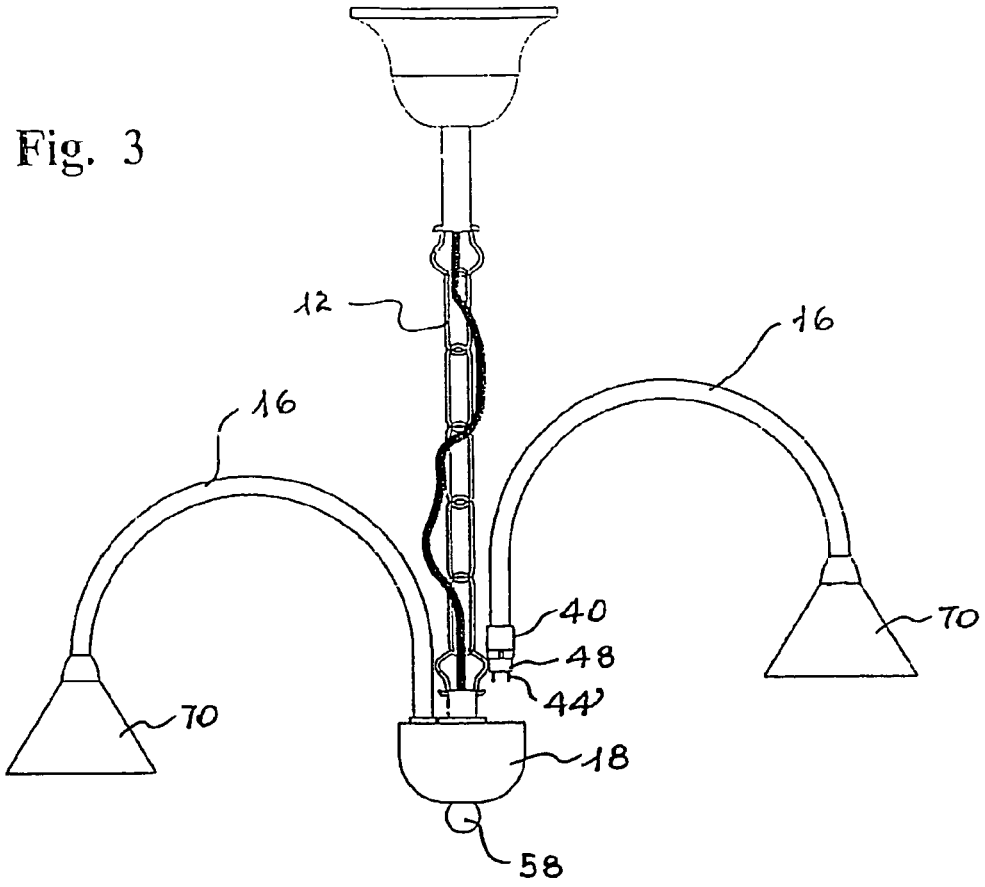
FIG. 3 schematically shows a side view of a lighting fixture according to the invention, wherein a first arm is coupled to the central support and a second arm is arranged in a position close to the insertion into the same support.

With reference to the above figures, the modular lighting fixture of the present invention is globally indicated with reference numeral 10 in FIG. 1, which shows a possible embodiment thereof in the form of a chandelier to hang to the ceiling. The lighting fixture 10 comprises a hanging element 12, for example consisting of linked metal rings to be fixed to the ceiling by the top end, a central support 14 fixed to the bottom end of the hanging element 12 and a plurality of arms 16, typically and not critically with arched development, which are fixed to the central support 14.

The latter comprises a containment body 18 by way of an example shaped as a tray, having a substantially hemispherical profile and open top front, wherein there is seated a plurality of overlapped components, as schematised in FIG. 8. In particular, in the containment body 18 there is inserted a circular plate 20 of insulating material, provided with two concentric seats 22 and 24 suitable for receiving respective conductors with annular development 22', 24' shaped as helical springs or spiral elements. Conductors 22' and 24' are surmounted by a cylindrical plate 26 of insulating material, peripherally provided with a plurality of equally spaced seats 28 which define as many cavities or wells with substantially circular plan, at the base provided with a pair of through holes 28'. Seats 28 are suitable for receiving the bottom end of respective arms 16 which, in the exemplary embodiment of FIG. 1, are six; also, it is understood that the cylindrical plate 26 may exhibit a larger or smaller number of seats 28 and that they may receive arms 16 only partly for forming, for example, a fixture with only two or three opposite arms or oriented at 1200 relative to one another. The disc-shaped body 32, made of metal or other suitable material, is provided with circular through openings 34 which are complementary to seats 28 of plate 26, whereon they are precisely overlapped. Both said seats 28 and the circular openings 34 peripherally exhibit an appendix notched outwards that acts as a reference and centring for the fitting in the central support 14 of arms 16, as detailed hereinafter. In the circular openings 34, the notched appendix is indicated with reference numeral 36, whereas the appendix of seats 16 is indicated with reference numeral 38.

Figure 4:
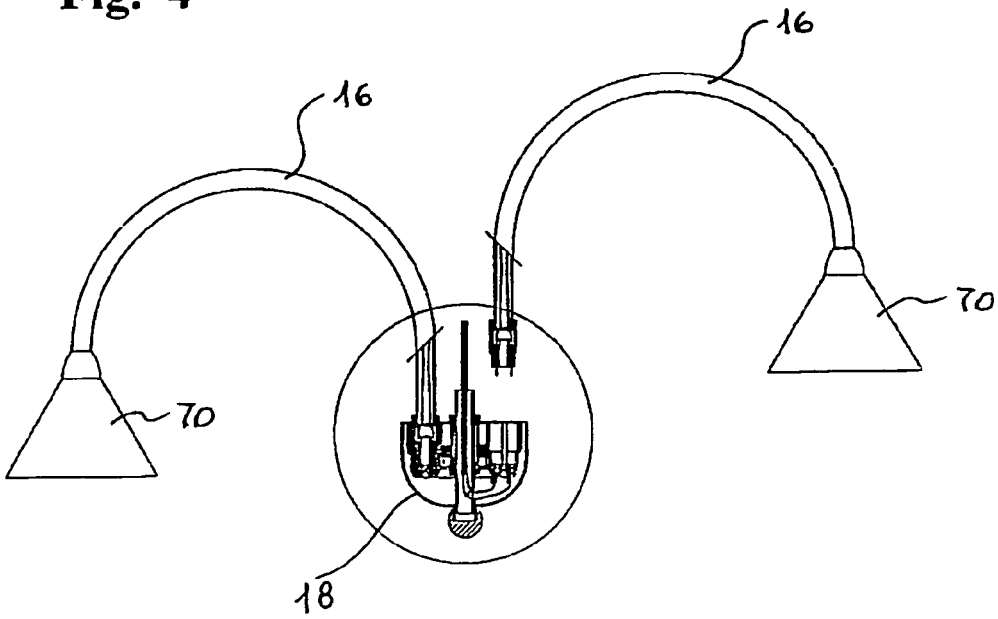
FIG. 4 shows a partial and cutaway view of FIG. 3.

According to the invention, the bottom end of arms 16 intended for the insertion into seats 28 is arranged in a metal sleeve 40 and stabilised therein through threading, welding, adhesives or other suitable fixing means. The conventional electrical cables 42 protrude from the bottom end of arms 16, crossing sleeve 40 and carrying respective pins 44. The latter, with parallelepiped shape, are crimped in a known manner to said cables, fit with the respective ends 44' into corresponding seats 46 of a cylindrical body 48 of plastic material and protrude at the bottom from the same body for inserting between two coils of the conductors with annular development 22', 24', as schematised in FIGS. 4 and 5. End 44' of pins 44 advantageously exhibits a quadrangular section that ensures wider contact surfaces, with the coils of the conductors with annular development 22', 24', compared to a circular section wherein the contact would be limited to opposite points.

The metal sleeve 40 is fitted on the cylindrical body 48 and it stabilises thereon by mechanical interference. A vertical notch 40' is made at the base of said sleeve, wherein a complementary projection 52 abuts, protruding from the side surface of the cylindrical body 48. The same projection 52 constitutes the abutment for the fitting, in openings 34 of the disc-shaped body 32 and in seats 28 of plate 26, of the assembly formed by each sleeve 40 and cylindrical body 48 assembled to one another. Each of said projections 52, in fact, mandatorily inserts into the corresponding notched appendix 36 of the disc-shaped body 32 and in the notched appendix 38 of plate 26.

In advance, or upon the assembly of the central support 14, the disc-shaped body 32 is centred on plate 26 so that said notched appendices 36 and 38 are perfectly superimposed.

Figures 5, 6:
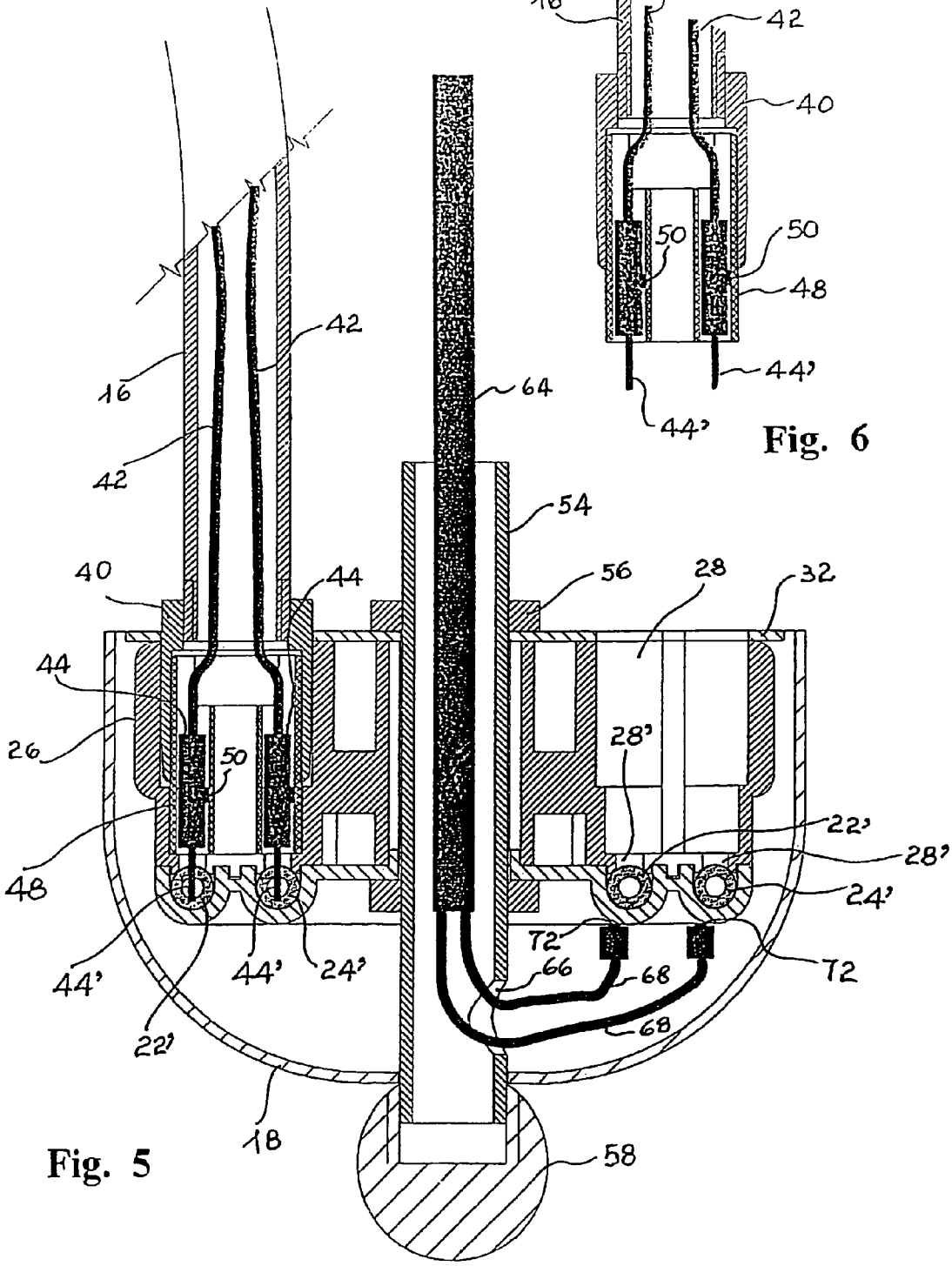
FIG. 5 shows an enlarged detail of FIG. 4.
FIG. 6 schematically shows a longitudinal section of the bottom end of one of the arms of the lighting fixture of the invention, showing the mechanical and electrical connection means to the relative support.
Figure 9:
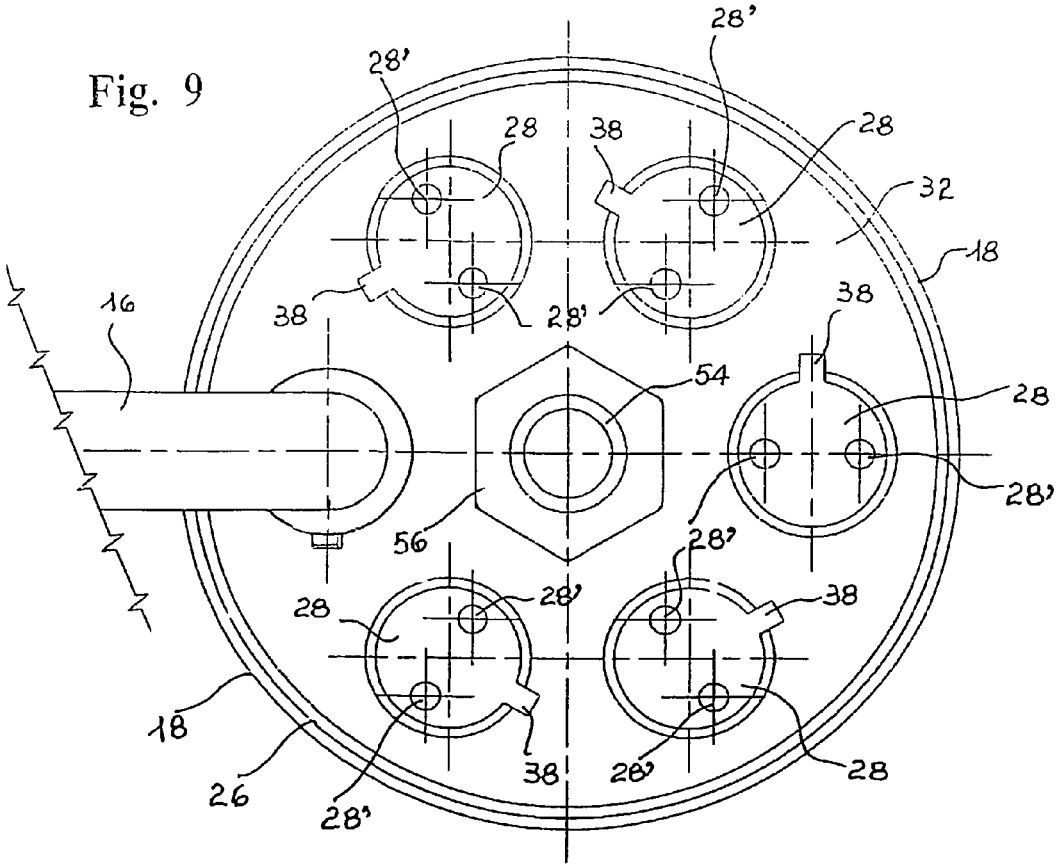
FIG. 9 schematically shows a plan view of the top front of said central support, once assembled.
Figure 10:
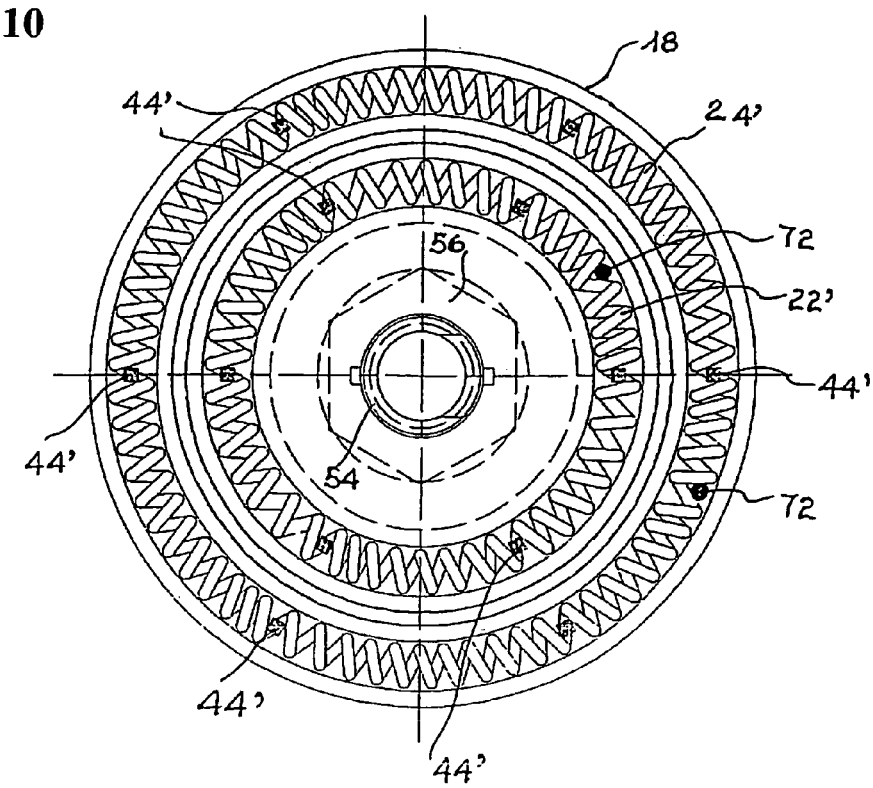
FIG. 10 schematically shows a plan view of the central support partially assembled, showing the electrical conductors with annular development

Pins 44 are provided with means suitable for stabilising them in an effective manner into seats 46 of the cylindrical body 48; said means consist of a fin 50, which protrudes along a face of the parallelepiped pins 44 and which, following the insertion of the latter into seats 46, hooks into an undercut (not shown), made along the same seats. The latter are opposite to one another in the cylindrical body 48 and define forced recesses for the insertion of pins 44, so that they and the respective ends 44' are spaced from each other by a predetermined extent which facilitates the insertion of the same ends into the spiral conductors 22' and 24' Said ends 44', based on their quadrangular section, abut the coils of the spiral conductors along a sufficiently wide surface for ensuring a safe contact. The assembly of the central support 14 is quick and easy, as to this end only a tubular element 54 and a pair of nuts or equivalent means 56, 58 are provided. Both the tray containment body 18 and the circular plate 90 as well as the cylindrical plate 26 and the disc-shaped body 32 are provided with a central through hole 60, wherethrough the tubular element 54 is driven, the opposite ends whereof are provided with threading. After having arranged the circular plate 20 into body 18, conductors 22', 24' in the concentric seats 22, 24, of the same, the cylindrical plate 26 on said conductors and finally, the disc-shaped body 32 on plate 26, the tubular element 54 protrudes both at the top and at the bottom from all of said elements superimposed to one another. Nut 56, as can be seen in particular in FIG. 5, is screwed to the top end of the tubular element 54 up to abutting the disc-shaped body 32; a similar nut or, preferably, a spherical or otherwise shaped body 58, with threaded hole 62 developed inwards, is screwed to the opposite bottom end of the tubular element 54, which protrudes at the bottom from the containment body 18.

The end portion of the power supply cable 64 passes through the tubular element 54 and through a hole 66 created into the same element in a suitable position, it allows the single cables 68 to connect from the bottom into the spiral conductors 22' and 24' through pins 72 or the like.

At this point it is sufficient to insert the single arms 16 into seats 28 for electrically powering, through cables 42, lamps or lighting bodies of any kind arranged in the respective lamp holders and shielded, for example, by diffusers 70 or the like, fixed to the free end of the same arms. The latter are first assembled in the bottom portion, so that the respective end of each of them partially fits into the metal sleeve 40, stabilising through a threading, or through previous welding work, or yet, with any other suitable means.

Afterwards, pins 44 are made to fit into seats 46 up to the point where fins 50 engage with the undercuts formed into the same seats whereas the metal sleeve 40 is easily fitted onto the cylindrical body 48 according to a precise orientation, determined by the presence of projection 52 on the latter, which is inserted into notch 40' of the same sleeve. Once pins 44 are stabilised into seats 46, ends 44' of the same protrude at the bottom from the cylindrical body 48 by an extent sufficient for introducing them between the coils of the electrical spiral conductors 22' and 24'.

The same ends 44', during the introduction step of the extreme bottom portion of the various arms 16 into seats 28, in fact pass through the pair of holes 28, indicated in FIG. 5, which are made at the base of said seats 28' and communicate with said electrical conductors 22', 24'.

At this point, each arm 16 thus assembled is inserted in one of seats 28 of the circular plate 26 surmounted by the disc-shaped body 32; this operation is veiny easy too, as the same projection 52 of the cylindrical body 48 acts as centring device relative to the notched appendices 36 of the disc-shaped body 32 and 38 of the cylindrical plate 26. Once the assembly has been made, each arm 16 is suitably supported by the metal sleeve 40, safe from possible dangerous bending. The central support 14 is effectively compacted by the disc-shaped body 32, which acts as top cover and at the same time, as aesthetical finish element.

With this construction setting, the modular lighting fixture of the present invention is compact when needed, that is, has limited dimensions thanks to the limited overall dimensions of the fittings of arms 16; the same arms may easily be coupled to the central support 14 or optionally detached therefrom for being carried by not very expert people too, provided that the insertion into seats 28 is forced according to a predetermined orientation and that the electrical power supply, as well as the mechanical stabilisation, are automatically obtained thanks to said insertion. Although the invention has been described hereinbefore with particular reference to an embodiment thereof made by way of a non-limiting example only, several changes and variations will appear clearly to a man skilled in the art in the light of the above description.

The present invention, therefore, is intended to include any changes and variations thereof falling within the spirit and the scope of protection of the following claims.

The invention claimed is:

1. A modular lighting fixture (10) provided with a plurality of arms (16) branching off a central support (14) which are inserted therein pressure-wise starting from the respective bottom ends thereof, said central support comprising a containment body (18) wherein a plate (20) is arranged, with concentric seats for as many spiral electrical conductors (22', 24') surmounted by cylindrical plate (26) of insulating material wherein a plurality of through seats (28) with circular plan or wells is peripherally obtained, starting from a plane (30), wherein the bottom ends of said arms (16) are inserted, provided with electrical cables (42) for powering a lighting body connected to the opposite top end of the arms, wherein the bottom end of said arms (16) is made integral to a sleeve (40) provided, along the base perimeter, with a vertical notch (40') intended for coupling with a projection (52) protruding from the outer side surface of a cylindrical body (48) whereon the sleeve (40) is fitted pressure-wise.

2. The lighting fixture according to claim 1, wherein said cylindrical body (48) is internally provided with opposite seats (46) wherein as many parallelpiped pins (44) are inserted, fixed to the cables (42), each of the ends (44') of the pins (44) being fitted between two adjacent coils of one of the spiral electrical conductors (22',24').

3. The lighting fixture according to claim 2, wherein the ends (44') of the pins (44) exhibit a quadrangular section.

4. The lighting fixture according to claim 2, wherein the parallelpiped pins (44) comprise a fin (50) protruding from one of the faces, intended for engaging in an undercut obtained along the seats (46) of the cylindrical body (48).

5. The lighting fixture according to claim 1, in that wherein the through seats (28) with circular plan of the cylindrical plate (26) of an insulating material are peripherally provided with an appendix (38) cut outwards constituting the fitting and centring reference for the arms (16) into same seats starting from the projection (52) of the cylindrical bodies (48).

6. The lighting fixture according to claim 5, wherein the cylindrical plate (26) is surmounted by a disc-shaped body (32), provided with circular through openings (34) complementary to the seats (28) of the cylindrical plate and peripherally provided with an appendix (36) cut outwards corresponding to the appendix (38).

7. The lighting fixture according to claim 6, wherein the containment body (18), the plates (20,26) and the disc-shaped body (32) are provided with a central through hole (60) for fixing a tubular element (54) with threaded ends for screwing a nut (56) or a spherical or differently shaped body (58) provided with a threaded hole (62) developed inwards, in the tubular element (54) there being arranged the end portion of an electrical supply cable (64) that comes out of a hole (66) from the tubular element for the connection of single cables (68) to the spiral electrical conductors (22',24') through pins (72).

8. The lighting fixture according to claim 1, wherein the containment body (18) is shaped as a basin having circular plan.

9. The lighting fixture according to claim 1, wherein the sleeve (40) is fixed to the bottom end of each arm by threading or other suitable retaining means and is made of metal.

* * * * *